US006516865B1

(12) United States Patent
Beeck et al.

(10) Patent No.: US 6,516,865 B1
(45) Date of Patent: Feb. 11, 2003

(54) HOLLOW-CAST COMPONENT

(75) Inventors: Alexander Beeck, Küssaberg (DE); Erhard Kreis, Otelfingen (CH); Ibrahim El-Nashar, Kloten (CH); Beat Von Arx, Trimbach (CH)

(73) Assignee: Alstom, Paris (FR)

( * ) Notice: Subject to any disclaimer, the term of this patent is extended or adjusted under 35 U.S.C. 154(b) by 329 days.

(21) Appl. No.: 09/650,407

(22) Filed: Aug. 29, 2000

Related U.S. Application Data

(62) Division of application No. 09/345,509, filed on Jul. 1, 1999, now Pat. No. 6,193,468.

(30) Foreign Application Priority Data

Feb. 11, 1999 (DE) ..... 199 05 887

(51) Int. Cl.[7] ..... B22D 27/04; B22C 9/04; B23P 6/00

(52) U.S. Cl. ..... 164/76.1; 164/164; 164/122.1; 164/132; 29/402.16; 29/402.17

(58) Field of Search ..... 164/122.1, 122.2, 164/132, 76.1; 29/402.16, 402.17

(56) References Cited

U.S. PATENT DOCUMENTS 2,821,323 A 1/1958 Lee
3,626,568 A * 12/1971 Silverstein et al. ..... 29/402.16
3,761,201 A 9/1973 Silverstein et al.
5,407,326 A 4/1995 Lardellier

FOREIGN PATENT DOCUMENTS

| | | |
|---|---|---|
| DE | 39 36 171 | 5/1991 |
| DE | 44 34 139 | 8/1995 |
| DE | 44 30 489 | 10/1995 |
| DE | 196 47 069 | 5/1998 |

* cited by examiner

*Primary Examiner*—Kuang Y. Lin
(74) *Attorney, Agent, or Firm*—Burns, Doane, Swecker & Mathis, L.L.P.

(57) ABSTRACT

In a hollow-cast component, a core opening (13) created during manufacturing is closed with a closure piece (14). This closure piece is located inside a recess (15) in the component, whereby the recess is arranged so that it is imbedded completely in the cast material, and completely covers the core opening. Because of this installation, the closure piece is fixed in a form-fitting manner in the direction of two spatial axes, so that the closure piece only needs to be secured with an additional joint in the installation direction. It is preferred that the installation direction is normal in relation to the direction of maximal stress of the closure piece, so that a joint is subject to a relatively small stress and therefore can be produced with little expenditure and a high degree of operational safety.

10 Claims, 1 Drawing Sheet

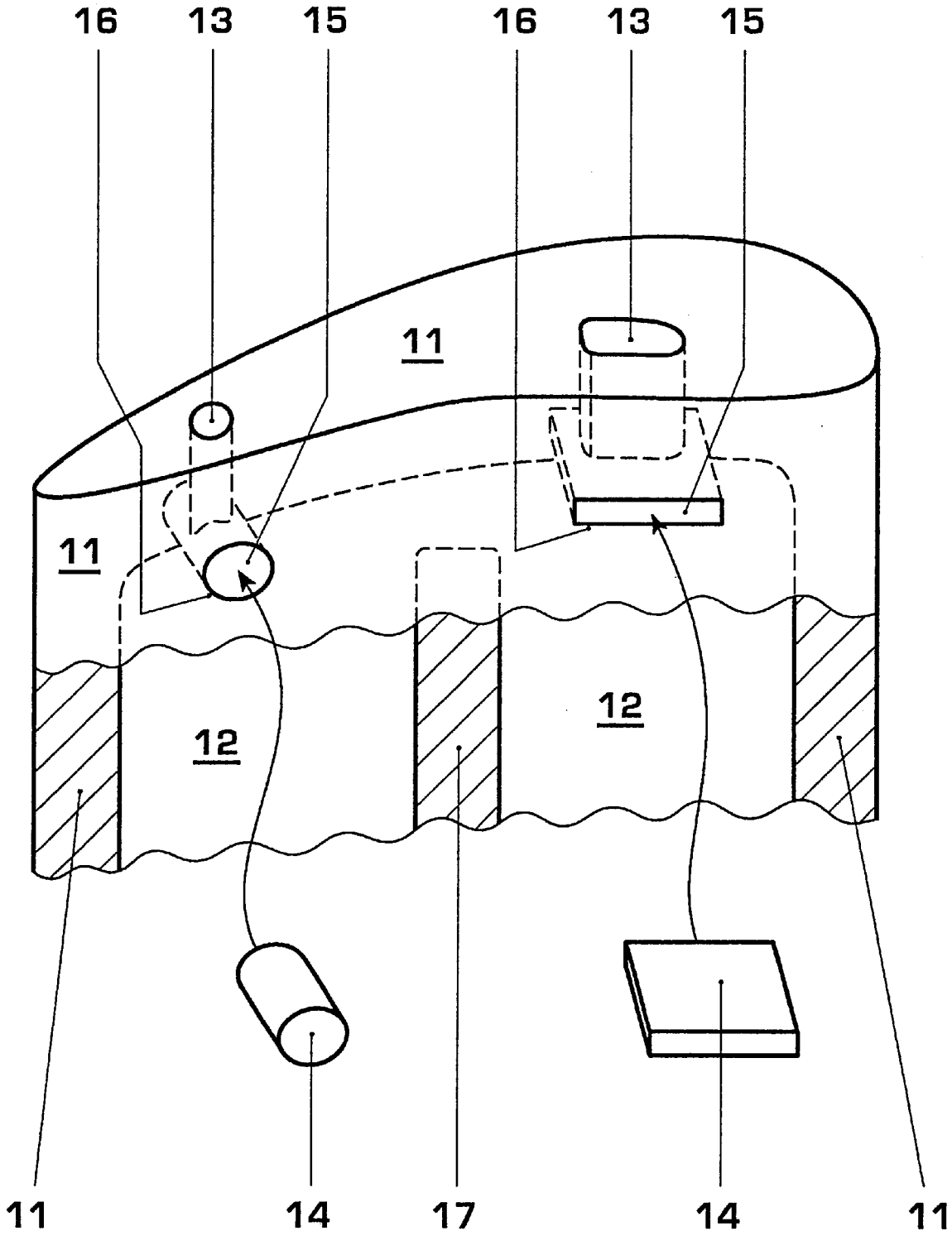
16
13
15
16
13
15
11
11
12
12
11
14
17
14
11

HOLLOW-CAST COMPONENT

This application is a divisional, of application No. 09/345509 filed Jul. 1, 1999 now U.S. Pat. No. 6,193,468, which is related to and claims priority under 35 U.S.C. §119 of German application No. 199 05 887.3. filed Feb. 11. 1999. the entire contents of both of which are incorporated by reference herein.

BACKGROUND OF THE INVENTION

1. Field of the Invention

The present invention relates to a hollow-cast component which encloses at least one hollow space.

2. Brief Description of the Related Art

When manufacturing high precision cast components, it is necessary that any existing cores are supported in the case mold in as stable a manner as possible. With rising requirements on manufacturing accuracy, the necessary dimensions of the core supports therefore in general rise also.

Because of the core supports, openings are created in the component's walls during casting. In many cases, these openings are not necessary for the component's function, or at least are not necessary to the degree that they are provided. To the contrary, excessively large and numerous core openings like these are, in most cases, undesirable since, on the one hand, they weaken the mechanical stability of the components, but, in particular, also represent undesirable leakage points.

As an example, reference is made in this context to a cooled gas turbine blade whose interior has been provided with complex cooling air channels. To create the internal structures of such blades, cores must be fixed very precisely and in a very stable manner in the cast mold. It is therefore desirable to secure the core, i.e., on the side of the blade base and on the side of the blade head, with large core supports. The large core openings thus created also facilitates the removal of the core from the hollow-cast blade and permit easy inspection on the hollow space.

But the cast component created in this manner has openings that are undesirable for its proper function. Although in the above mentioned example of a cooled gas turbine blade, relatively large openings at the blade base are desired to bring cooling air into and remove air from the blade interior, openings that are desirable or even necessary in terms of production technology, especially on the blade head, often lead to damaging cooling air leakage.

In the past, the goal was to keep the core supports as small as possible at those places where an opening was not to be provided in any case. But this solution increases casting tolerances. Very small bores are not processed any further, while a closure piece is welded or soldered over the hole in larger openings. The latter approach is not without problems, especially if the component is used in the hot gas part of gas turbines, i.e., the closure piece and the seam are directly exposed to the hot gas. High temperature alloys, as those used for gas turbine blades, often are hard to weld also. There is therefore a latent danger that the attached closure piece separates from the component, and the previously closed opening is again open. This risk of a separating closure piece is especially high if it is attached to the head of a rotor blade, for which an additional centrifugal force is in effect. The closure piece also can be separated if a rotor blade brushes against the housing, or if a guide blade brushes against the rotor elements.

Especially in the above described example of a gas turbine blade, this failure of the closure piece may result in a sensitive shift in the cooling air balance, potentially resulting in a component failure with serious consequences as a result of overheating.

On the other hand, as was described above, the core openings cannot be completely eliminated without having to accept drastically greater casting tolerances and drastic reduction in the designer's freedom when designing the hollow spaces, i.e., when designing the component cooling.

It would therefore be desirable to use the largest possible core supports because of production technology considerations, while on the other hand the resulting core openings must be reliably closed. The current state of the art does not provide any suitable possibility for accomplishing this.

SUMMARY OF THE INVENTION

It is an objective of the invention to describe the closing of the core openings for a hollow-cast component, where said component encloses at least one hollow space, and said component is being run through by at least one core opening made during manufacturing in such a way that the above described disadvantages are avoided.

According to a first exemplary embodiment, a hollow-cast component comprises a surface and at least one hollow space, at least one core opening made during manufacturing of said component, a closure piece, said at least one core opening being closed with said closure piece, and at least one recess accessible from the outside of said component, a penetration of said at least one recess forming a closed line with said surface of said component, said at least one recess covering said at least one core opening within said component in its entirety, said closure piece being also arranged inside said at least one recess.

According to a second exemplary embodiment, a method for producing a hollow-cast component, said hollow-cast component including a surface, at least one hollow space, at least one core opening, and at least one recess accessible from the outside of said component, a penetration of said at least one recess forming a closed line with said surface of said component, said at least one recess covering said at least one core opening within said component in its entirety, comprises the steps of, casting said component with a cast mold and a casting core to form said hollow space, said casting core being fixed during said casting step by core supports in said cast mold, forming said at least one recess in said component which at least one recess covers at least one of said at least one core openings, removing said casting core after said casting step through said core openings created by said core supports, closing said core openings with a closure piece after said step of removing said casting core by inserting said closure piece from the outside of said component into said at least one recess, said closure piece having a size selected from the group consisting of smaller than, the same as, or larger than that of said at least one recess, fixing said closure piece in said at least one recess.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which the single drawing figure illustrates a very simplified portrayal of the head area of a cooled, hollow-cast gas turbine blade in which core openings have been constructed in a closable manner in accordance with an exemplary embodiment of the present invention.

DESCRIPTION OF THE PREFERRED EMBODIMENTS

According to the present invention a hollow-cast component is provided with at least one recess accessible from the outside so that penetration of the recess forms a closed line with the surface of the cast component, that the recess covers the at least one closed core opening within the component in its entirety, and that the closure piece is arranged inside the recess.

Stated differently, this means that a closure piece is placed inside the cast component. The closure piece is located in a recess that spans the closure piece in a form-fitting manner in the direction of two spatial axes. This requires an additional fixation only in the direction of one movement axis. If the closure piece must absorb, e.g., pressure differentials or centrifugal forces when the cast component is placed into a technical system, the recess is advantageously placed into the component in such a manner that the direction into which an additional fixation of the closure piece is necessary is located as normal, perpendicular, or orthogonal as possible in relation to the main force component. The closure piece then must be only secured against slipping inside the recess. Because of this measure, the attachment of the closure piece is subject to a much smaller stress than is the case for the solution according to the state of the art. This feature of the present invention alone drastically increases the functional safety of a core opening closure.

In hollow-cast components that are exposed to hot media from the outside and through which conduct cooling air flows inside the hollow space, both the closure piece and any possibly present seams are exposed to the hot gas to a much lesser degree than is the case according to the state of the art.

The closure piece set into the recess is able to hermetically close off the core opening or may leave a defined flow cross-section between the hollow space and the core opening, something which may be particularly useful for cooling purposes, for example. The latter can be achieved if the closure piece either does not completely cover the core opening or by integrating a defined opening into the closure piece.

A preferred place for attaching the closure piece or recess is directly at the transition from the hollow space enclosed by the cast component to the core opening. The recess and the closure piece may have almost any optional shape. The geometry of the closure piece naturally must be adapted to the one of the recess. The recess may be, e.g., a slit cast into the cast component or may have been made by cutting, whereby this slit is oriented transversely to the core opening and whereby a flat, small plate is placed into it as a closure piece. It is also possible that a pin is set into a cylindrical or conical bore.

When manufacturing a hollow component according to the invention, the blank is first cast in the usual manner. Since it is possible to later reliably close core openings created during this process, the core supports can be produced with generous dimensions, which significantly improves the manufacturing accuracy during the casting process. The recess may hereby be provided already in the blank, so that successive finishing steps are facilitated or eliminated. By cutting with an end-milling cutter or drill, the recess can be finished for dimensional accuracy; if no recess is provided in the cast blank, it must be made later. The finishing naturally can be accomplished with many processes, e.g., eroding; selection of the processing method will be readily apparent to one of ordinary skill in the art. Then the closure piece is set into the recess and is fixed in it. As described above, the closure piece must be adapted to the geometry of the recess. Depending on the mechanical or thermal stress as well as finishing possibilities, the closure piece can be attached in different ways. One example is gluing with an adhesive It is possible to further attach the closure piece by soldering or welding, for example, whereby the seams, as explained above, arc exposed to less stress. The closure piece could also be manufactured with oversized dimensions and then be pressed into the recess of the cast component utilizing a temperature differential, or an elastic expanding pin could be inserted in order to achieve a frictional bond. The closure piece in the form of a threaded round bolt also could be screwed in, or could be caulked with the cast component, resulting in a form-fitting connection. In the end, the selection of the attachment process in the actual case will depend on the expected temperature, the materials, and available manufacturing methods and tools.

Especially if, during operation, a flow is supposed to take place around the cast component, it is furthermore practical to design the outside of the component to be as smooth as possible after the closure piece has been installed. This may be accomplished in a simple manner by giving the closure piece such dimensions that it projects beyond the component surface after installation and is then ground down so it is completely flush.

Processes in accordance with the present invention are particularly suitable for manufacturing cooled gas turbine blades. The inside of these blades contains hollow spaces that extend essentially from the blade base to the blade head and have cooling air flow through them. These cooling air channels in general have sophisticated, complex geometries that must be manufactured with great accuracy during casting. This high accuracy requires a stable, bilateral support of the cast cores, therefore requiring generously sized core supports at the blade head and at the blade base. For this reason, the blank has core openings both at the head and at the base, whereby at least part of these core openings must be closed to prevent any loss of cooling air through them. The prior art process for closing the core openings may present significant problems. The seams of the closure pieces that have been installed from the outside are exposed to high temperatures, and the closure pieces at the head of a rotor blade are subject to significant centrifugal forces. In addition, high temperature alloys which must be used for such an application are hard to weld. This brings with it the hidden danger that the joint—which is subject to high mechanical as well as thermal stresses during operation—will fail, resulting successively in an impaired cooling air distribution with serious consequences. The present invention can remedy this by closing the core openings.

To illustrate the invention, the only figure shows the head area of a gas turbine blade as an example for a hollow-cast component. This blade contains hollow spaces 12 which are divided from each other by a dividing bar 17 and are bordered towards the outside by walls 11 of the cast component. The inner structure of the cast component shown in the drawing figure should be considered as only exemplary of cast components. During the casting of the shown blade, cores had to be positioned in and removed from the cast mold in order to create the hollow spaces. In order to stabilize the core position, i.e., to increase the casting accuracy, the cores were positioned at the blade head with two core supports that left behind the core openings 13 which must be closed in the cast component. For the purpose of closing these core openings, the cast component is provided with recesses 15, each of which covers a core opening. The recesses are completely integrated into the cast part in such a way that their penetration line 16 forms a closed line with the component surface. Matching closure pieces 14 with a small play or over-size are inserted into the recesses, as is shown by the arrows, and are fixed there in a suitable manner.

The closure pieces only need to be secured against slipping in one movement direction, i.e., in their installation direction. The installation direction can be selected so that it is the direction of the smallest stress. If the shown turbine blade is, e.g., a rotor blade, it will be mostly a centrifugal force which in this drawing acts upward on the closure pieces. But since the latter have been installed in essence vertically (perpendicular) to the direction of this force, the attachment need not bear the centrifugal force, but it is supported directly on the cast material. The joints with which the closure pieces are attached to the cast component therefore are only subject to a small mechanical stress.

The closure pieces illustrated are a small plate and a bolt. The recess for the bolt can be produced easily by drilling, while the one for the small plate requires complicated machining. On the other hand, the recess for the bolt must be relatively large, and therefore weakens the structure of the cast component more, so that this solution is hardly practical for very large core openings. Other shapes of closure pieces can alternatively be used within the scope of the present invention.

A bolt could, for example, also have an external thread and be screwed into a recess with an internal thread, resulting in a very simple way of attaching the closure piece in the cast component.

The shown exemplary embodiment is intended solely to facilitate the understanding of the invention as it is characterized in the claims and should not be understood to limit the invention. In addition to the shown example, the invention also allows a number of additional design variations whose discussion would far exceed the scope of this specification.

While the invention has been described in detail with reference to preferred embodiments thereof, it will be apparent to one skilled in the art that various changes can be made, and equivalents employed, without departing from the scope of the invention.

What is claimed is:

1. A method for producing a hollow-cast component, said hollow-cast component including a surface, at least one hollow space, at least one core opening, and at least one recess accessible from the outside of said component, a penetration of said at least one recess forming a closed line with said surface of said component, said at least one recess covering said at least one core opening within said component in its entirety, comprising the steps of:

casting said component with a cast mold and a casting core to form said hollow space, said casting core being fixed during said casting step by core supports in said cast mold;

forming said at least one recess in said component which at least one recess covers at least one of said at least one core openings;

removing said casting core after said casting step through said core openings created by said core supports;

closing said core openings with a closure piece after said step of removing said casting core by inserting said closure piece from the outside of said component into said at least one recess, said closure piece having a size selected from the group consisting of smaller than, the same as, or larger than that of said at least one recess;

fixing said closure piece in said at least one recess.

2. A method in accordance with claim 1, wherein said step of fixing said closure piece includes fixing said closure piece in said component with a material bond.

3. A method in accordance with claim 1, wherein said step of fixing said closure piece includes fixing said closure piece in said component by gluing with an adhesive.

4. A method in accordance with claim 1, wherein said step of fixing said closure piece includes pressing said closure piece into said cast component.

5. A method in accordance with claim 1, wherein said step of fixing said closure piece includes fixing said closure piece in a form-fitting connection with the recess.

6. A method in accordance with claim 1, wherein said closure piece projects beyond said cast component surface after inserting therein and further comprising grounding down said closure piece so that it is flush with said surface after said step of fixing said closure piece in said at least one recess.

7. A method in accordance with claim 1, wherein said cast component is a gas turbine blade having a blade head and a blade base, whereby said core supports at said blade head and said blade base extend out of the inside of said blade in the direction of the blade top, whereby said core openings are formed in said blade head and in said blade base, and whereby said step of closing said core openings comprises closing at least said core openings in said blade head.

8. The method in accordance with claim 1, wherein said step of fixing said closure piece includes fixing said closure piece in said component by utilizing a temperature differential or an inserted elastic pin to achieve a frictional bond.

9. The method in accordance with claim 1, wherein said step of fixing said closure piece includes fixing said closure piece in said component by soldering or welding.

10. The method in accordance with claim 5, wherein said form-fitting connection includes a threaded bolt screwed in the component or a closure piece caulked with the component.

* * * * *